US006076891A

United States Patent [19]

Bernhardt

[11] Patent Number: 6,076,891

[45] Date of Patent: Jun. 20, 2000

[54] DUAL-PIVOT MULTI-POSITION RATCHETING CHAIR ARM

[76] Inventor: Sean E. Bernhardt, 3401 Pearl St., Santa Monica, Calif. 90405

[21] Appl. No.: 09/046,979

[22] Filed: Mar. 24, 1998

Related U.S. Application Data

[60] Provisional application No. 60/065,891, Nov. 17, 1997.

[51] Int. Cl.[7] ..... A47C 7/54

[52] U.S. Cl. ..... 297/411.31; 403/96; 297/411.37

[58] Field of Search ..... 297/411.35, 411.37, 297/36, 38, 173; 403/96, 92

[56] References Cited

U.S. PATENT DOCUMENTS

| | | | |
|---|---|---|---|
| 3,119,591 | 1/1964 | Malecki | 403/96 X |
| 3,829,159 | 8/1974 | Leffler | 297/417 |
| 4,429,918 | 2/1984 | Alsup, Jr. et al. | 297/411.35 X |
| 4,438,975 | 3/1984 | Williams | 297/412 |
| 4,452,487 | 6/1984 | Plowman | 297/411 |
| 4,881,843 | 11/1989 | Randleman | 403/92 |
| 5,143,468 | 9/1992 | Pausch | 403/96 X |
| 5,188,423 | 2/1993 | Meiller et al. | 297/412 |
| 5,380,065 | 1/1995 | Rohrer | 297/411.37 |
| 5,393,124 | 2/1995 | Neil | 297/411.35 |
| 5,407,249 | 4/1995 | Bonutti | 297/411.37 X |
| 5,590,934 | 1/1997 | Gibbs | 297/411.38 |
| 5,597,208 | 1/1997 | Bonutti | 297/411.35 |
| 5,599,067 | 2/1997 | Schuelke et al. | 297/411.35 |
| 5,655,814 | 8/1997 | Gibbs | 297/411.37 X |

OTHER PUBLICATIONS

Declaration of Sean Bernhardt dated May 14, 1998 (pp. 1–3) with Photographs 1–14 (pp. 1–7).

Quill Semi–Annual Legal & Office Products Catalog (May–Oct. 1997) pp. 509–518.

*Primary Examiner*—Peter M. Cuomo
*Assistant Examiner*—Stephen Vu
*Attorney, Agent, or Firm*—Christie, Parker & Hale, LLP

[57] ABSTRACT

A dual-pivot adjustable armrest assembly includes a support column and a first and second horizontal pivot arms. The first horizontal pivot arm is pivotally coupled to the support column to allow rotation around a first vertical axis of rotation. The second horizontal pivot arm is pivotally coupled to the first horizontal pivot arm to allow rotation around a second vertical axis of rotation, which is independent from rotation of the armrest about the first axis. The armrest assembly allows incremental rotation of 360 degree about each axes of rotation so that the armrest can be rotated to selected positions.

27 Claims, 7 Drawing Sheets

DUAL-PIVOT MULTI-POSITION RATCHETING CHAIR ARM

This application claims priority pursuant to 35 U.S.C. §119(e) and 37 CFR §1.78(a)(4), to provisional Application Ser. No. 60/065,891 Nov. 17, 1997.

FIELD OF THE INVENTION

The present invention relates generally to chair arms, and more particularly to a dual-pivot, multi-position ratcheting chair arm.

BACKGROUND OF THE INVENTION

In virtually all aspects of life, one of the most common positions that a person finds himself or herself in is being seated in a chair. Whether behind the desk at work, in an automobile or airplane, or simply relaxing at home, a significant portion of each day is spent in a chair. Unfortunately, however, most of the chairs in use today are not ergonomically designed. As a result, users of these chairs often experience significant discomfort after extended periods of use.

Research has shown that one of the most important factors in the overall comfort of a chair is the proper positioning and alignment of the armrests. Generally speaking, a person sitting in a chair without armrests is more likely to experience a higher degree of pain, skeletal, and muscular problems over time, especially in the neck, shoulder, and upper arm region, than a person sitting in a chair with armrests. However, the mere presence of armrests does not necessarily eliminate the discomfort discussed above, because the armrests may not be properly positioned or aligned for a particular user of the chair. In other words, for a given chair design, the proper positioning and alignment of the armrests may differ for different users of the chair. Every user is likely to have a unique combination of the position and alignment of the armrests that provides the optimum comfort.

Therefore, adjustable chair armrests are well known and widely used in an attempt to improve the overall comfort level of today's chairs. An exemplary embodiment of such an adjustable chair armrest is disclosed in U.S. Pat. No. 5,590,934 to Gibbs. An adjustable chair armrest is provided that is rotatable about a vertical axis. A positioning plate of the armrest includes a plurality of positioning holes that define a series of potential positions or orientations of the armrest.

Although such an adjustable armrest provides greater flexibility than a fixed or stationary armrest, there are still significant disadvantages associated with the armrest disclosed in Gibbs that are typical of the problems associated with preexisting adjustable chair armrests in general. For example, the armrest in Gibbs is only capable of assuming a select few positions through a portion of its rotation. As with other preexisting adjustable chair armrests, a finite range of positions and orientations of the armrest cannot guarantee the optimum level of comfort for all users of the chair. Moreover, the armrest disclosed in Gibbs, and other preexisting adjustable chair armrests, only contains a single axis of rotation, which naturally limits the range of possible positions of the armrest, and therefore, limits the overall level of comfort available from the armrest. While the use of multiple axes of rotation is known in some areas, such as in various equipment associated with donating blood, the design of this equipment is poorly suited for use in armrest assemblies.

Consequently, as a result of these and other disadvantages associated with preexisting armrests, a need exists for an improved adjustable chair armrest.

SUMMARY OF THE INVENTION

The present invention, therefore, provides an improved adjustable chair armrest designed to minimize the disadvantages associated with the preexisting armrests described above. In a presently preferred embodiment, the adjustable armrest is a dual-pivot armrest which is capable of rotating around two independent vertical axes of rotation. The armrest includes a support column for attaching the armrest to the chair, a first horizontal pivot arm pivotally coupled to the support column, and a second horizontal pivot arm pivotally coupled to the first horizontal pivot. A first axis of rotation or pivot-point is defined by the coupling of the first horizontal pivot arm to the support column, and a second axis of rotation or pivot-point is defined by the coupling of the second horizontal pivot arm to the first horizontal pivot arm.

In one embodiment, the first and second vertical axes of rotation are independent from one another. Preferably, the force necessary to rotate the first horizontal pivot arm around the first axis of rotation is less than the force necessary to rotate the second horizontal pivot arm around the second axis of rotation, so that the pivots may be selectively operated independently.

The armrest assembly is capable of rotating a full 360 degrees around each of the first and second vertical axes of rotation. Specifically, the armrest assembly is capable of incrementally rotating around each of the first and second vertical axes of rotation so that the armrest may be positioned in selected positions of laterally inward, outward, and angular orientation.

In one embodiment, a plurality of bearing cavities and corresponding spring-biased ball bearings are utilized at each of the pivot-points of the armrest assembly to allow for the incremental rotation about each pivot point. The bearing cavities create a series of selected positions at which the arm can be located while being pivoted around each of the axes of rotation.

BRIEF DESCRIPTION OF THE DRAWINGS

These and other features and advantages of the present invention will be appreciated as the same become better understood by reference to the following Detailed Description when considered in connection with the accompanying drawings, wherein.

DETAILED DESCRIPTION OF THE INVENTION

Figure 1:
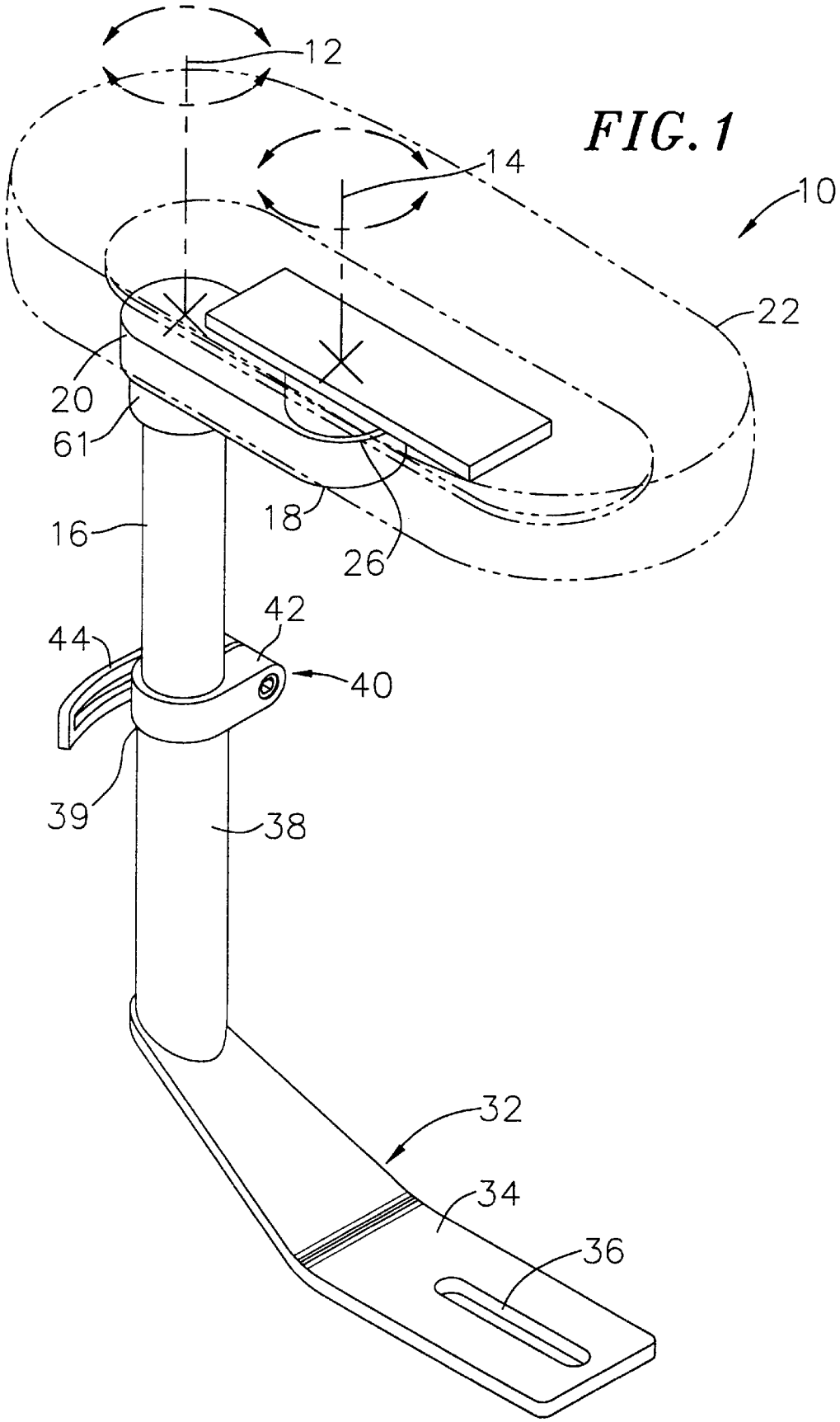
FIG. 1 is a perspective view of a dual-pivot, multi-position chair armrest assembly according to the present invention, with the second horizontal pivot arm illustrated in phantom.
Figure 2:
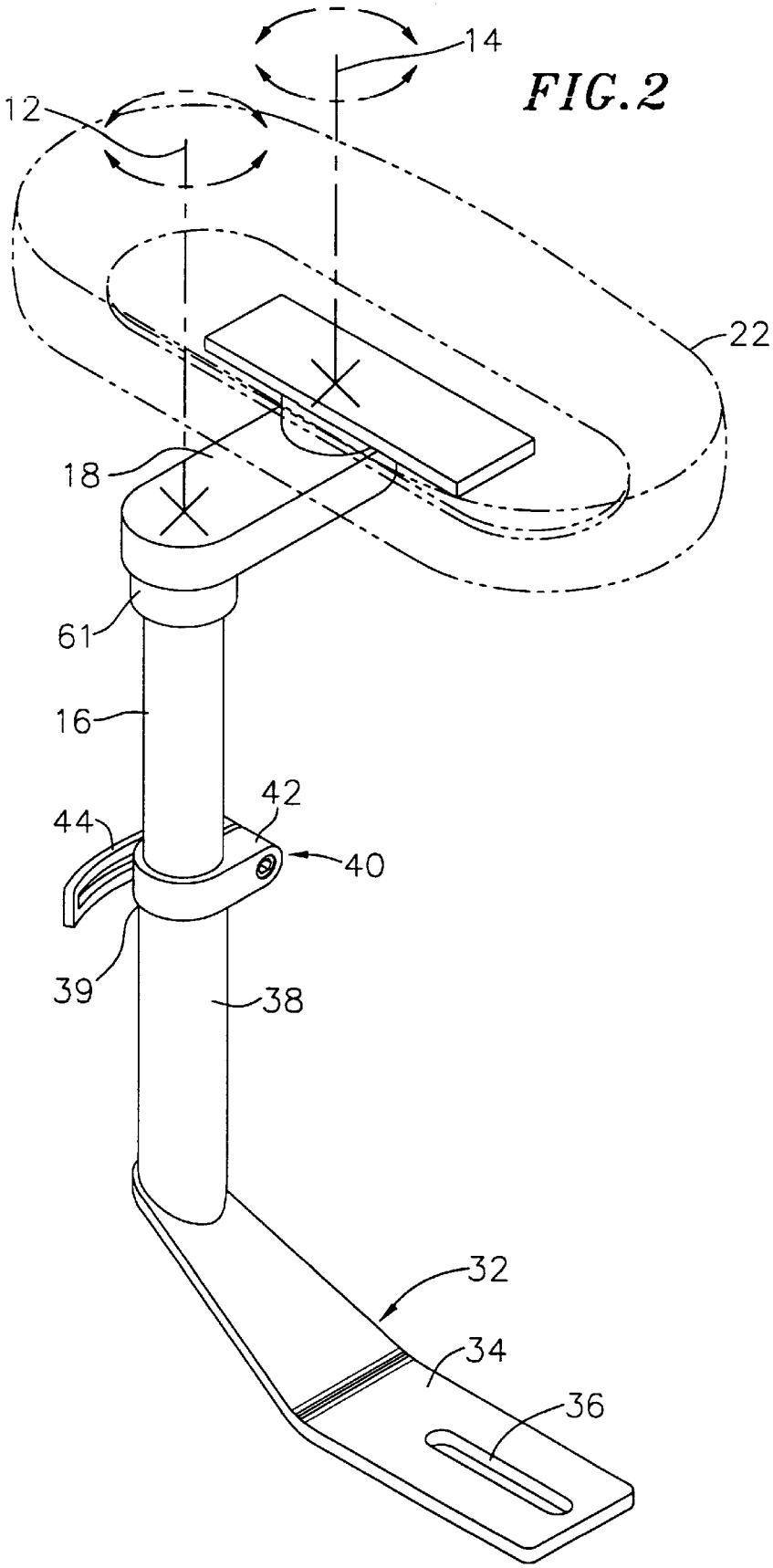
FIG. 2 is a perspective view of the armrest assembly of FIG. 1 wherein the armrest has been pivoted around both axes of rotation.

Referring now to the figures, and in particular FIGS. 1 and 2, the adjustable chair armrest assembly 10 according to the present invention is illustrated. In a presently preferred embodiment, the armrest assembly 10 is a dual-pivot, multi-position ratcheting armrest assembly. The armrest 10 includes two independent vertical axes of rotation 12, 14 which allow the armrest to be positioned in an almost countless number of different positions, thus providing an optimum level of comfort for all users. Specifically, the armrest 10 allows for full 360 degree rotation around each of its independent axes of rotation 12, 14. A spring-biased ball bearing system is utilized at each axis of rotation to provide a ratcheting mechanism that allows for incremental rotational adjustment of the armrest about each axis. This combination, therefore, allows the armrest according to the present invention to be adjusted to any lateral inward, outward, and angular position. This ergonomic design allows each user of the armrest assembly to have an individually appropriate armrest position, both in terms of should width and seat depth from his or her work.

To accomplish this, the armrest assembly includes a vertical support column 16 coupled to a chair (not shown), a first horizontal pivot arm 18, pivotally coupled to the support column 16 at one end 20 of the pivot arm 18 to allow full rotation of the first pivot arm 18 around axis 12, and a second horizontal pivot arm 22, pivotally coupled to an end 26 of the first pivot arm 18, opposite end 20, to allow full rotation of the second pivot arm 22 around axis 14.

Preferably, the chair onto which the armrest assembly 10 according to the present invention is attached includes a platform 28 (FIG. 3) having an upper mounting surface 30. The armrest assembly is mounted to the chair by a chair platform mounting structure 32, having an adjustable mounting plate 34. A longitudinal slot 36 is located on one end of the mounting plate 34, to allow longitudinal adjustment of the armrest assembly 10 relative to the chair platform 28. Conventional fasteners (not shown) or other suitable means may be used to secure the mounting structure 32 to the platform 28.

The mounting plate 34 also includes a sleeve 38, opposite the longitudinal slot 36, extending vertically upward from the mounting plate 34 for receiving the support column 16 of the armrest assembly. Preferably, the sleeve 38 and post 16 are appropriately dimensioned to allow for a slidable fit between the components, thus facilitating easy adjustment of the armrest height.

Figure 7:
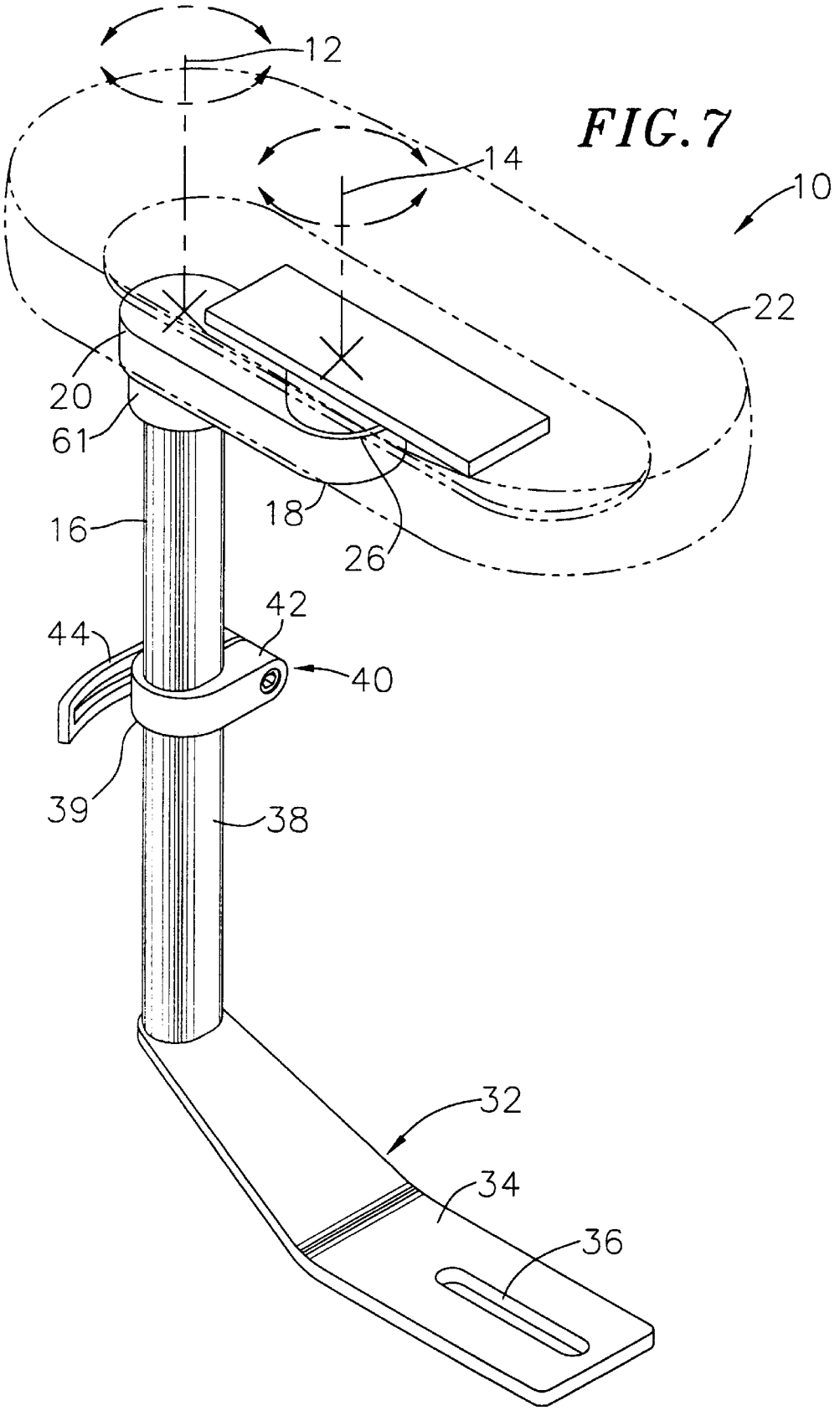
FIG. 7 is an alternate embodiment of the armrest assembly of FIG. 1 with an oval support column and sleeve for facilitating alignment of the armrest.

Preferably, the armrest assembly includes means for aligning the support column 16 with the sleeve 38 so that the armrest is properly oriented in an initial position. In the embodiment illustrated in FIG. 7, the support column 16 and sleeve 38 each have a matching oval cross-section to facilitate proper alignment of the relative components, although other means for aligning may alternatively be used.

Once the support column 16 is set to a desired armrest height (taking into account the height of the first and second pivot arms of the assembly) retaining means 40 may be operated to secure the armrest at that height. In the embodiment illustrated in FIGS. 1 and 2, the retaining means comprises a clamp 42 at the intersection of the upper end 39 of the sleeve and the column 16. When a different armrest height is desired, the clamp 42 is loosened, the position of the column 16 adjusted relative to the sleeve 38, and then the clamp 42 is tightened. The clamp 42 illustrated in FIGS. 1 and 2 includes a handle 44 that allows quick and easy loosening and tightening of the clamp.

Figure 3:
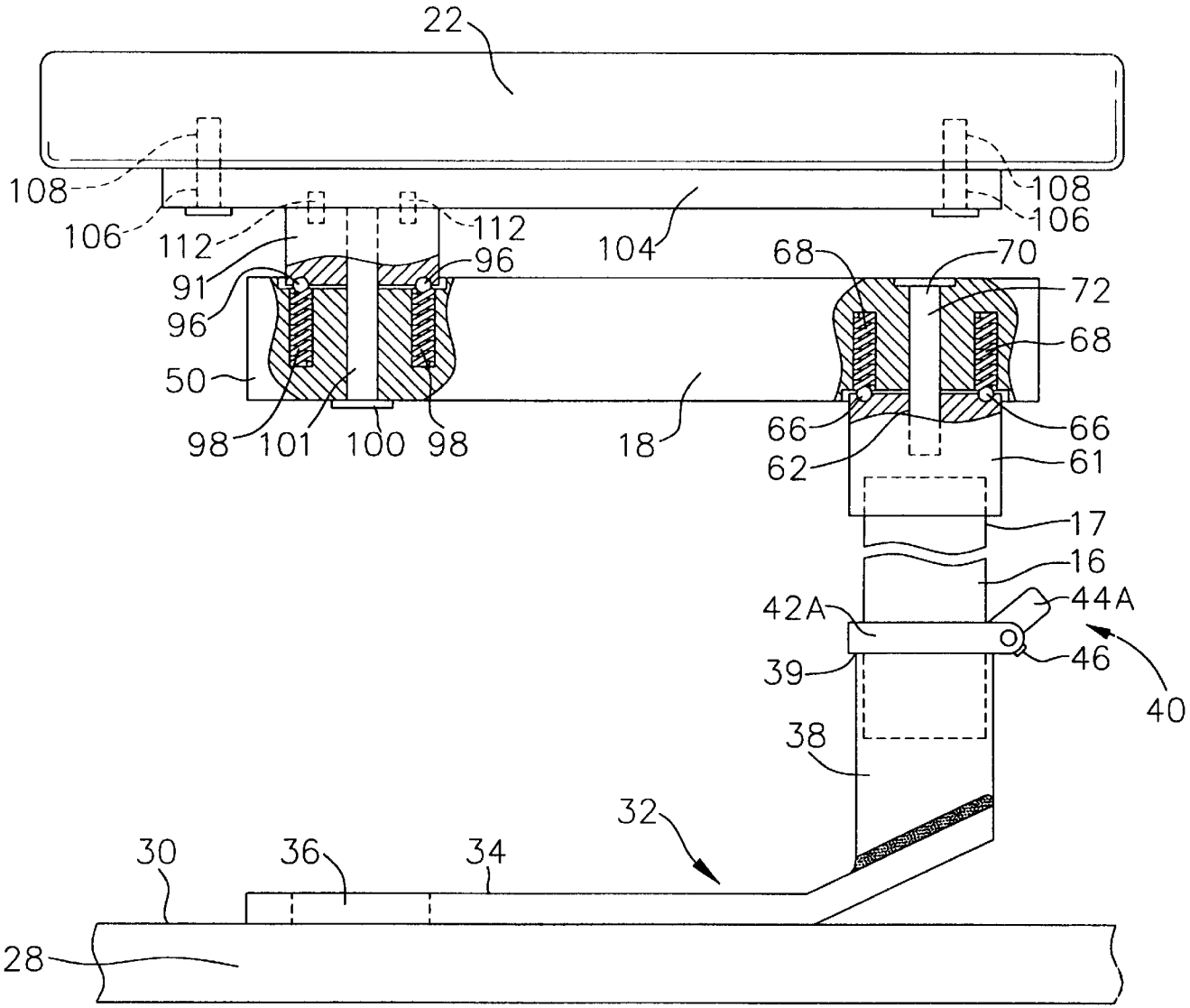
FIG. 3 is a partial cross-sectional side view of the armrest assembly of FIG. 1.

Referring now to FIG. 3, an alternate embodiment of the clamp 42A is illustrated. An integral clamping lever 44A is provided for loosening and tightening the clamp 44A as desired. Preferably, a first set screw 46 is used so that when the clamp 42A is tightened, the position set by the clamping lever 44A is properly maintained. As a further securing element, a second set screw 46A may be located on the clamp at a location that causes the second set screw 46A to substantially perpendicularly intersect with and lock the first set screw 46 in its set position. It should be noted that any other suitable retaining means may be used in connection with the present invention.

One of the advantages of the present invention is that it is only necessary to adjust the height of the assembly once, prior to using the armrest. Once the height has been adjusted, the armrest may be moved inwardly or outwardly as necessary to enter or exit the chair, or adjusted relative to the two independent axes of rotation as desired to provide an ergonomical work environment.

Figure 5A:
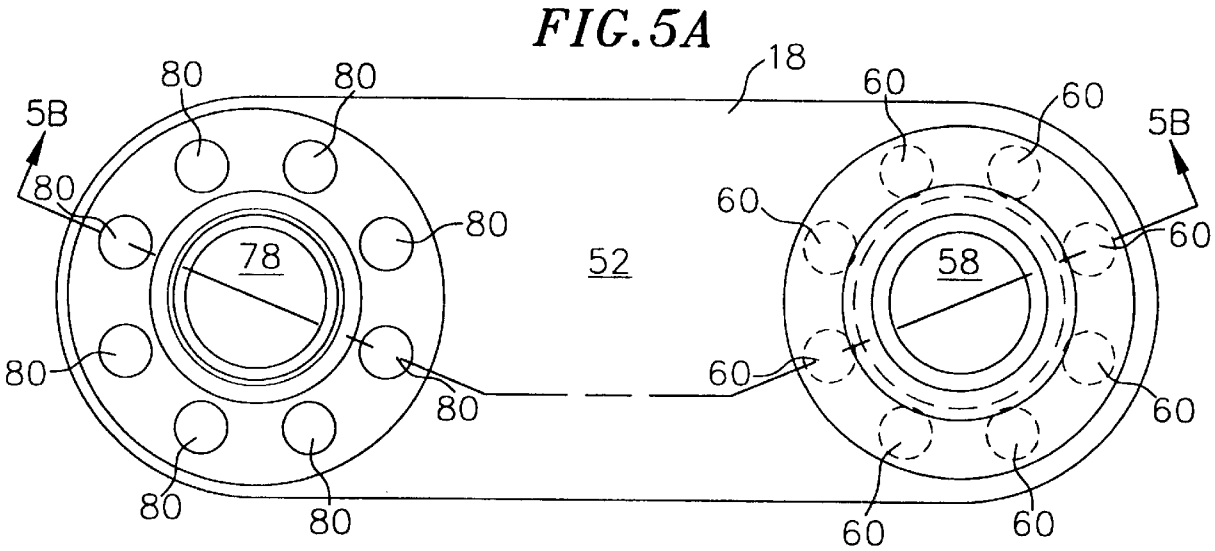
FIGS. 5A and 5B are a top elevation view of the first horizontal pivot arm of the armrest assembly of FIG. 1, and a cross-sectional view of the first horizontal pivot arm of FIG. 5B taken along line 5B—5B, respectively.
Figure 5B:
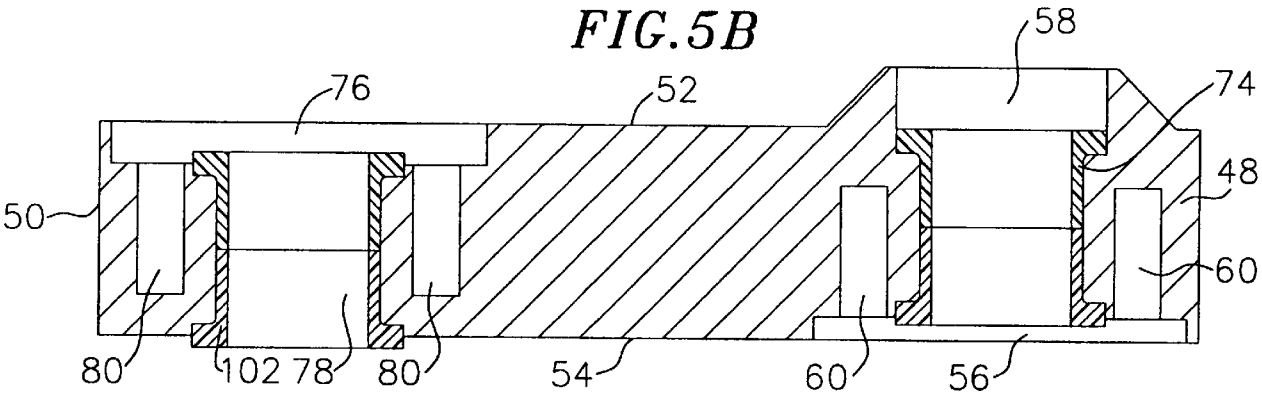

Rotation of the armrest assembly about axis 12 is provided by the first horizontal pivot arm 18. Referring to FIGS. 5A and 5B, the first horizontal pivot arm includes a proximal end 48, a distal end 50, an upper surface 52 and a lower surface 54. On the lower surface 54 of the first horizontal pivot arm, a first bearing race cavity 56 is provided adjacent the proximal end 48. A first bore 58 is centrally located in the race cavity 56, and extends upward through the first horizontal pivot arm 18. Additionally, a plurality of first bearing cavities 60 or recesses are provided around the perimeter of the race cavity 56, and extend upward into the first horizontal pivot arm 18. In a presently preferred embodiment, eight circular first bearing cavities 60 are provided in a circular arrangement around the bore 58, as illustrated in FIG. 5A. The number of bearing cavities 60 determines, in part, the incremental rotational adjustment of the armrest assembly around axis 12. Therefore, those skilled in the art should realize that more or less bearing cavities may alternatively be used in the present invention.

The first horizontal pivot arm 18 is pivotally coupled to the upper end 17 of the support column 16. In a presently preferred embodiment (FIG. 3), a spacer 61, which is coupled to the upper end of the support column, is used to couple the first horizontal pivot arm to the support column, although alternatively, the two components could be coupled directly to one another.

Figure 4A:
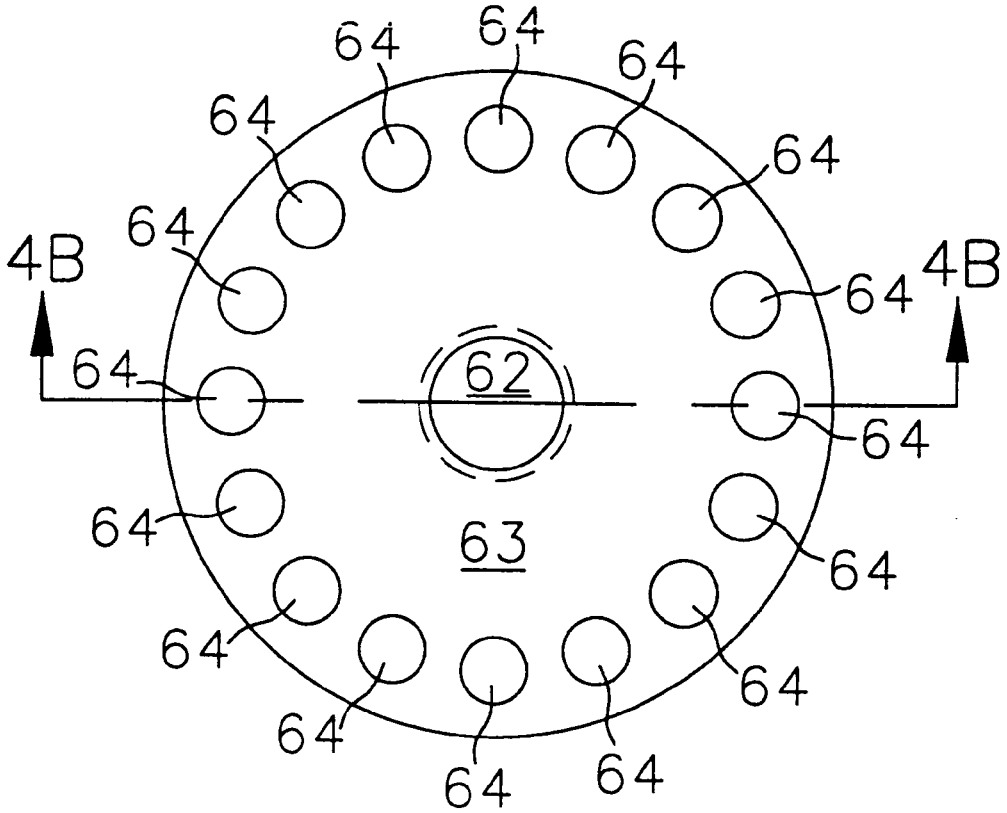
FIGS. 4A and 4B are a top elevation view of the support column of the armrest assembly of FIG. 1, and a cross-sectional view of the support column of FIG. 4A taken along lines 4B—4B, respectively
Figure 4B:
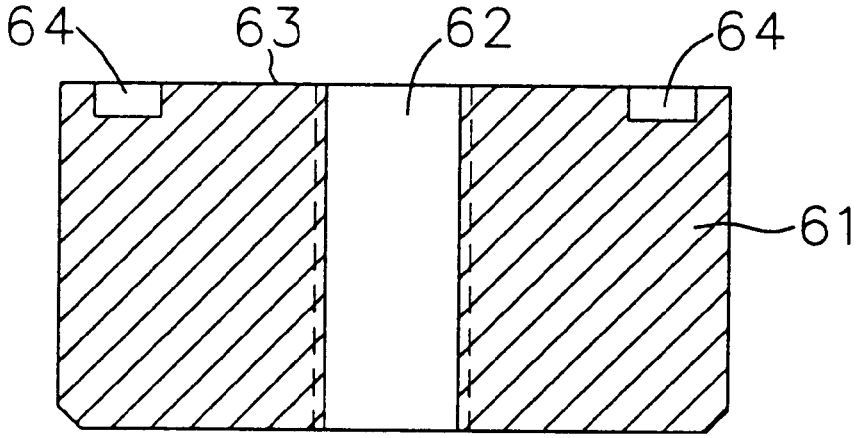

To facilitate the pivotal coupling of the first horizontal arm, the spacer 61 (FIGS. 4A and 4B) includes a first threaded bore 62, centrally located on the upper end face 63 of the spacer and extending down into the spacer, and a plurality of first bearing receiving cavities 64 also extending down into the spacer. In a presently preferred embodiment, sixteen circular first bearing receiving cavities 64 are provided in a circular arrangement around the mounting bore 62, which is substantially similar to the circular arrangement of the plurality of first bearing cavities 60. The number of bearing receiving cavities 64 determines, in part, the incremental rotational adjustment of the armrest assembly around axis 12. Therefore, those skilled in the art should realize that more or less bearing receiving cavities or other bearing arrangements may alternatively be used in the present invention.

To allow for incremental rotational adjustment of the first horizontal pivot arm, a plurality of spring-loaded ball bearings (FIG. 3), each comprising a ball bearing 66 and a compression spring 68, are captured between the plurality of first bearing cavities 60 and the plurality of first bearing receiving cavities 64. The compression spring 68 of each of the plurality of spring-loaded ball bearings extends into a corresponding first bearing cavity 60 and biases a corresponding ball bearing into one of the bearing receiving cavities.

In a presently preferred embodiment, a first pivot bolt 70 is used to couple the first horizontal pivot arm 18 to the spacer 61, and thus to the support column 16. The pivot bolt 70 is inserted into the bore 58 in the pivot arm 18, and then into the threaded bore 62 of the spacer, which is aligned with the bore 58. Preferably, the bolt 70 has a smooth neck 72 to facilitate rotation of pivot arm 18 around the bolt. Additionally, in one embodiment, at least one bushing or sleeve 74 (FIG. 5B) is provided in the bore 58 to further facilitate rotation of pivot arm 18 around the bolt. For example, in a presently preferred embodiment, a double bushing is provided in the bore 58.

With the first horizontal pivot arm thus coupled to the support column, the pivot arm can be incrementally rotated through a full 360 degree circle around axis 12. As the armrest is rotated around axis 12, the ball bearings 66 are received in different bearing receiving cavities so that the armrest can be rotated in a horizontal plane around axis 12 to selected positions.

In the embodiment described above, the ratio of the plurality of first bearing cavities to the plurality of first bearing receiving cavities is 1:2. This ratio is presently preferred because it allows an empty bearing receiving cavity to be adjacent to each ball bearing. Those skilled in the art, however, should realize that other ratios may alternatively be utilized in connection with the present invention to provide more or less adjustment positions or vary the resulting force for a given number of bearings and spring tension.

In a presently preferred embodiment, the bolt 70 is tightened to a predetermined level during manufacturing of the armrest assembly, so that no further adjustment is required by the end user. The spring force of compression springs 68 may be varied as needed to adjust the resulting force necessary to rotate the pivot arm 18 around axis 12. Alternatively, those skilled in the art should realize that the armrest assembly may alternatively be provided with means for allowing the user to vary or adjust the force required to rotate the pivot arm 18 around axis 12.

The armrest assembly 10 according to the present invention also includes a second axis of rotation 14. Rotation of the armrest assembly about axis 14 is provided by the second horizontal pivot arm 22, which is pivotally coupled to the distal end 50 of the first horizontal pivot arm 18. Referring again to FIGS. 5A and 5B, on the upper surface 54 of the first horizontal pivot arm 18, a second bearing race cavity 76 is provided adjacent the distal end 50. A second bore 78 is centrally located in the race cavity 76, and extends downward through the first horizontal pivot arm 18. Additionally, a plurality of second bearing cavities 80 or recesses are provided around the perimeter of the race cavity 76, and extend downward into the first horizontal pivot arm. In a presently preferred embodiment, eight circular second bearing cavities 80 are provided in a circular arrangement around the bore 78, as illustrated in FIG. 5A. The number of bearing cavities 80 determines, in part, the incremental rotational adjustment of the armrest assembly around axis 14. Therefore, those skilled in the art should realize that more or less bearing cavities or other bearing arrangements may alternatively be used in the present invention.

The second horizontal pivot arm 22 is pivotally coupled to the proximal end 50 of the first horizontal pivot arm 18. In a presently preferred embodiment, a spacer 91, which is coupled to the lower surface of the second pivot arm, is used to couple the two pivot arms together.

Figure 6C:
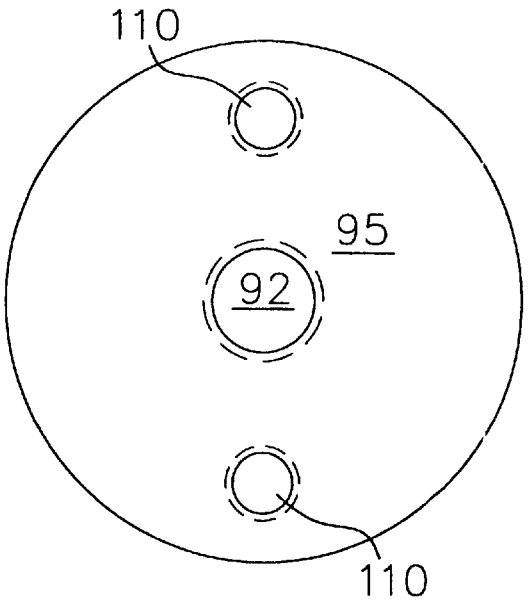
FIGS. 6A, 6B, and 6C are a bottom elevation view of the spacer of the armrest assembly of FIG. 1, a cross sectional view of the spacer of FIG. 6A taken along lines 6B—6B, and a top elevation view of the spacer of FIG. 6A, respectively.
Figure 6B:
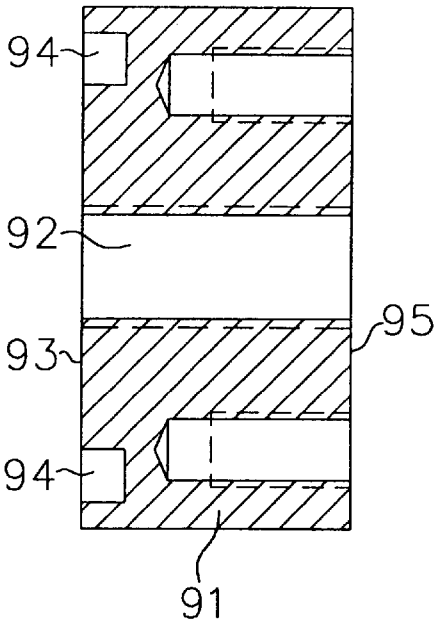
Figure 6A:
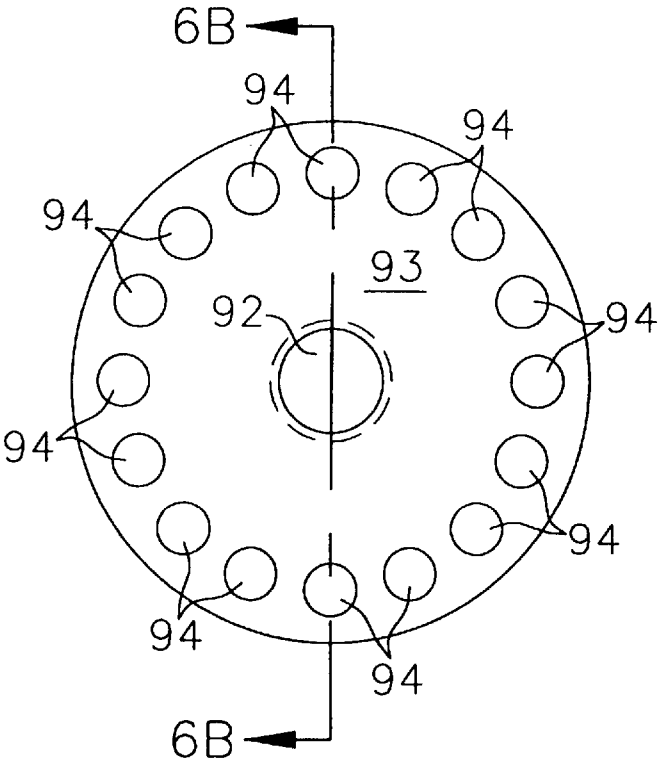

To facilitate the pivotal coupling of the second horizontal arm, the spacer 91 (FIGS. 6A, 6B, and 6C) includes a second threaded bore 92, centrally located on the lower end face 93 of the spacer, and extending upwards into the spacer, and a plurality of second bearing receiving cavities 94, also extending upwards into the spacer. In a presently preferred embodiment, sixteen circular second bearing receiving cavities are provided in a circular arrangement around the threaded bore 92, which is substantially similar to the circular arrangement of the plurality of second bearing cavities 80. The number of bearing receiving cavities 94 determines, in part, the incremental rotational adjustment of the armrest assembly around axis 14. Therefore, those skilled in the art should realize that more or less bearing receiving cavities or other bearing arrangements may alternatively be used in the present invention.

To allow for incremental rotational adjustment of the second horizontal pivot arm 22, a plurality of spring-loaded ball bearings (FIG. 3), each comprising a ball bearing 96 and a compression spring 98, are captured between the plurality of second bearing cavities 80 and the plurality of second bearing receiving cavities 94. The compression spring 98 of each of the plurality of spring-loaded ball bearings extends into a corresponding second bearing cavity 80 and biases a corresponding ball bearing 96 into one of the second bearing receiving cavities 94 .

In a presently preferred embodiment, a second pivot bolt 100 is used to couple the second horizontal pivot arm 22 to the spacer 91, and thus to the first horizontal pivot arm 18. The pivot bolt 100 is inserted into the bore 88 in the pivot arm 22, and then into the threaded bore 92 of the spacer 91, which is aligned with the bore 88. Preferably, the bolt 100 has a smooth neck 101 to facilitate rotation of the pivot arm 22 around the bolt 100. Additionally, in one embodiment, at least one bushing or sleeve 102 (FIG. 5B) is provided in the bore 78 to further facilitate rotation of the pivot arm 22 around the bolt 100. For example, in a presently preferred embodiment, a double bushing is provided in the bore 78.

As noted above, the spacer 91 is coupled to the second horizontal pivot arm. In the embodiment illustrated in FIG. 3, an arm mounting plate 104 is provided between the spacer and the pivot arm 22. Bores 106 are provided at each end of the mounting plate to secure the mounting plate to the lower surface of the pivot arm 22, through the use of conventional fasteners 108. Additionally, a plurality of bores 110 (FIG. 6C) are provided in the upper surface 95 of spacer 91 to allow conventional fasteners 112 to be used to secure the spacer 91 to the lower surface of the mounting plate 104.

With the second horizontal pivot arm thus coupled to the first horizontal pivot arm, the second horizontal pivot arm can be incrementally rotated through a full 360 degree circle around axis 14. As the armrest is rotated around axis 14, the ball bearings 96 are received in different bearing receiving cavities so that the armrest can be rotated in a horizontal plane around axis 14 to selected positions.

In the embodiment described above, the ratio of the plurality of second bearing cavities to the plurality of second bearing receiving cavities is 1:2. This ratio is presently preferred because it allows an empty bearing receiving cavity to be adjacent to each ball bearing. Those skilled in the art, however, should realize that other ratios may alternatively be utilized in connection with the present invention to provide more or less adjustment positions or vary the resulting force for a given number of bearings and spring tension.

In a presently preferred embodiment, the bolt 100 is tightened to a predetermined level during manufacturing of the armrest assembly, so that no further adjustment is required by the end user. The spring force of compression springs 98 may be varied as needed to adjust the resulting force necessary to rotate the pivot arm 22 around axis 14. Alternatively, those skilled in the art should realize that the armrest assembly may alternatively be provided with means for allowing the user to vary or adjust the force required to rotate the pivot arm 22 around axis 14.

Preferably, the armrest assembly is designed so that relatively less force is required to rotate pivot arm 18 around axis 12 than is needed to rotate pivot arm 22 around axis 14. Thus, the pivots of the armrest assembly could be selectively operated independently, allowing the armrest to be placed in any laterally inward, outward and angular position as desired to provide the optimum comfort level. Alternatively, however, the resulting force required to rotate either of the pivot arms around their respective axes may be adjusted as dictated by the particular application.

It should be noted that the armrest described herein may be utilized with any type of chair where an adjustable armrest is desirable, especially when the chair is used for task-oriented functions, such as office or desk chairs.

While various embodiments of this invention have been shown and described, it would be apparent to those skilled in the art that many more modifications are possible without departing from the inventive concept herein. For example, the rotational adjustment increments of the armrest assembly can be varied as necessary to allow a more fine adjustment of the armrest position. By decreasing the space between adjacent cavities, each rotational adjustment increment is decreased. The space between adjacent bearing receiving cavities is a function of the diameter of the circular arrangement of the cavities, and the number of bearing receiving cavities forming that circular arrangement. Therefore, those skilled in the art should realize that either of these variables may be adjusted as necessary to provide the desired rotational adjustment increment. It is therefore to be understood that within the scope of the appended claims, this invention may be practiced otherwise than as specifically described.

What is claimed is:

1. An adjustable armrest assembly for a chair, the armrest assembly comprising:

a support column for attaching the armrest to the chair;

a first horizontal pivot arm pivotally coupled to the support column to define a first vertical axis of rotation and having a first force set at a Predetermined level required to rotate the first pivot arm around the first axis; and a second horizontal pivot arm pivotally coupled to the first horizontal pivot arm to define a second vertical axis of rotation and having a second force set at a predetermined second level required to rotate the second pivot arm around the second axis, wherein the first force and second force are each capable of being varied from their predetermined levels and adjusted independently of one another.

2. The adjustable armrest assembly according to claim 1 wherein the first and second vertical axes of rotation each require a different force to rotate their respective pivot arms around the axes and are independently operable from one another.

3. The adjustable armrest assembly according to claim 1 wherein the armrest assembly is capable of rotating a full 360 degrees around at least one of the first and second vertical axes of rotation.

4. The adjustable armrest assembly according to claim 1 wherein the armrest assembly is capable of rotating a full 360 degrees around each of the first and second vertical axes of rotation.

5. The adjustable armrest assembly according to claim 1 wherein the armrest assembly is capable of incremental rotational about at least one of the first and second vertical axes of rotation.

6. The adjustable armrest assembly according to claim 1 wherein the armrest assembly is capable of incremental rotational about each of the first and second vertical axes of rotation.

7. The adjustable armrest assembly according to claim 1 wherein the first horizontal pivot arm comprises a first mounting bore adjacent a proximal end of the first horizontal pivot arm, and a second mounting bore adjacent a distal end of the first horizontal pivot arm, and wherein a first pivot bolt extends through the first mounting bore to pivotally couple the first horizontal pivot arm to the support column, and wherein a second pivot bolt extends through the second mounting bore to pivotally couple the second horizontal pivot arm to the first horizontal pivot arm.

8. The adjustable armrest assembly according to claim 7 wherein the first horizontal pivot arm further comprises a plurality of first bearing cavities in the proximal end of the first horizontal pivot arm, each of the plurality of first bearing cavities extending upward from a lower surface of the first horizontal pivot arm, and a plurality of second bearing cavities in the distal end of the first horizontal pivot arm, each of the plurality of second bearing cavities extending downward from an upper surface of the first horizontal pivot arm.

9. The adjustable armrest assembly according to claim 8 wherein the plurality of first bearing cavities are in a substantially circular arrangement around the first mounting bore, and wherein the plurality of second bearing cavities are in a substantially circular arrangement around the second mounting bore.

10. The adjustable armrest assembly according to claim 8 further comprising a plurality of first bearing receiving cavities opposite of, and corresponding to, the plurality of first bearing cavities, and a plurality of second bearing receiving cavities opposite of, and corresponding to, the plurality of second bearing cavities.

11. An adjustable armrest assembly for a chair, the armrest assembly comprising:

a support column for attaching the armrest to the chair;

a first horizontal pivot arm pivotally coupled to the support column to define a first vertical axis of rotation;

a second horizontal pivot arm pivotally coupled to the first horizontal pivot arm to define a second vertical axis of rotation;

wherein the first horizontal pivot arm comprises a first mounting bore adjacent a proximal end of the first horizontal pivot arm, and a second mounting bore adjacent a distal end of the first horizontal pivot arm, and wherein a first pivot bolt extends through the first mounting bore to pivotally couple the first horizontal pivot arm to the support column, and wherein a second pivot bolt extends through the second mounting bore to pivotally couple the second horizontal pivot arm to the first horizontal pivot arm;

wherein the first horizontal pivot arm further comprises a plurality of first bearing cavities in the proximal end of the first horizontal pivot arm, each of the plurality of first bearing cavities extending upward from a lower surface of the first horizontal pivot arm, and a plurality of second bearing cavities in the distal end of the first horizontal pivot arm, each of the plurality of second bearing cavities extending downward from an upper surface of the first horizontal pivot arm;

a plurality of first bearing receiving cavities opposite of, and corresponding to, the plurality of first bearing cavities, and a plurality of second bearing receiving cavities opposite of, and corresponding to, the plurality of second bearing cavities; and a first spacer for coupling the first horizontal pivot arm to the support column, and a second spacer for coupling the second horizontal pivot arm to the first horizontal pivot arm, wherein the plurality of first bearing receiving cavities is located in an upper surface of the first spacer, and wherein the plurality of second bearing receiving cavities is located in a lower surface of the second spacer.

12. The adjustable armrest assembly according to claim 10 further comprising a plurality of spring-biased ball bearings positioned between the plurality of first bearing cavities and the plurality of first bearing receiving cavities, and between the plurality of second bearing cavities and the plurality of second bearing receiving cavities.

13. The adjustable armrest assembly according to claim 12 wherein the ratio of the plurality of first bearing cavities to the plurality of first bearing receiving cavities is about 1:2.

14. The adjustable armrest assembly according to claim 13 wherein the ratio of the plurality of second bearing cavities to the plurality of second bearing receiving cavities is about 1:2.

15. The adjustable armrest assembly according to claim 13 wherein the plurality of first bearing cavities comprises eight bearing cavities.

16. The adjustable armrest assembly according to claim 15 wherein the plurality of second bearing cavities comprises eight bearing cavities.

17. The adjustable armrest assembly according to claim 1 further comprising means, on the support column, for adjusting the height of the armrest assembly.

18. The adjustable armrest assembly according to claim 1 wherein the force necessary to rotate the second horizontal pivot arm around the second axis of rotation is greater than the force necessary to rotate the first horizontal pivot arm around the first axis of rotation.

19. A dual-pivot armrest comprising:

a support column for attaching the armrest to the chair;

a first horizontal pivot arm coupled to the support column; and a second horizontal pivot arm coupled to the first horizontal pivot arm, wherein the armrest includes a first pivot-point between the first horizontal pivot arm and the support column having a first force set at a predetermined first level required to rotate the first pivot arm around the first pivot-point and a second pivot-point between the second horizontal pivot arm and the first horizontal pivot arm having a second force set at a predetermined second level required to rotate the second pivot arm around the second pivot-point, and wherein, the first force level is different from the second force level and the first pivot-point is independently operable from the second pivot-point.

20. The dual-pivot armrest according to claim 19 further comprising means for incrementally rotating the first horizontal pivot arm around the first pivot-point and for incrementally rotating the second horizontal pivot arm around the second pivot-point.

21. An adjustable armrest assembly comprising:

a support column for attaching the armrest to the chair' a first horizontal pivot arm pivotally coupled to the support column to define a first vertical axis of rotation and capable of rotating a full 360 degrees around the first axis, the first horizontal pivot arm comprising a plurality of first bearing cavities in a proximal end of the first horizontal pivot arm, each of the plurality of first bearing cavities extending upward from a lower surface of the first horizontal pivot arm;

a plurality of first bearing receiving cavities opposite of, and corresponding to, the plurality of first bearing cavities; and a plurality of spring-biased ball bearings positioned between the plurality of first bearing cavities and the plurality of first bearing receiving cavities.

22. The adjustable armrest assembly according to claim 21 wherein the first horizontal pivot arm further comprises a plurality of second bearing cavities in a distal end of the first horizontal pivot arm, each of the plurality of second bearing cavities extending downward from an upper surface of the first horizontal pivot arm, and wherein the adjustable armrest further comprises a second horizontal pivot arm pivotally coupled to the first horizontal pivot arm to define a second vertical axis of rotation;

a plurality of second bearing receiving cavities opposite of, and corresponding to, the plurality of second bearing cavities; and a plurality of spring-biased ball bearings positioned between the plurality of second bearing cavities and the plurality of second bearing receiving cavities.

23. The adjustable armrest assembly according to claim 21 further comprising means on the support column for adjusting the height of the armrest relative to the chair.

24. The adjustable armrest assembly according to claim 21 further comprising means for aligning the armrest assembly and the chair.

25. The adjustable armrest assembly according to claim 24 wherein the aligning means comprises a substantially oval-shaped support column and a substantially oval-shaped sleeve coupled to the chair for receiving the support column.

26. An adjustable armrest assembly comprising a support column for attaching the armrest to the chair;

a horizontal pivot arm pivotally coupled to the support column defining a vertical axis of rotation; and a plurality of spring-loaded bearings each set at a predetermined force level on which the pivot arm rotates and that provide a force resisting rotation;

wherein the horizontal pivot arm is capable of incremental rotation of 360 degrees around the vertical axes of rotation.

27. An adjustable armrest assembly for a chair, the armrest assembly comprising:

a support column for attaching the armrest to the chair;

a first horizontal pivot arm pivotally coupled to the support column to define a first vertical axis of rotation;

a first adjustment means for controlling a first pivoting force to pivot the first horizontal pivot arm in the first vertical axis of rotation;

a second horizontal pivot arm pivotally coupled to the first horizontal pivot arm to define a second vertical axis of rotation; and a second adjustment means for controlling a second pivoting force to pivot the second horizontal pivot arm in the second vertical axis of rotation.

* * * * *